US005419233A

United States Patent [19]

Mulvaney

[11] Patent Number: 5,419,233

[45] Date of Patent: May 30, 1995

[54] PORTABLE SHOOTER'S BENCH REST

[76] Inventor: Loren Mulvaney, Box 61, Merrillan, Wis. 54754

[21] Appl. No.: 279,359

[22] Filed: Jul. 25, 1994

[51] Int. Cl.[6] ..... F41A 23/16

[52] U.S. Cl. ..... 89/37.04; 42/94; 73/167

[58] Field of Search ..... 89/37.04; 42/94; 73/167

[56] References Cited

U.S. PATENT DOCUMENTS

| | | | |
|---|---|---|---|
| 1,367,353 | 2/1921 | Craig | 42/94 |
| 3,125,929 | 3/1964 | Peasley | 89/37.04 |
| 4,026,057 | 5/1977 | Cady | 42/94 |
| 4,296,963 | 10/1981 | Blanchard et al. | 297/170 |
| 4,501,082 | 2/1985 | Phillips et al. | 42/94 |
| 4,545,144 | 10/1985 | Schuster | 42/94 |
| 4,702,029 | 10/1987 | DeVaul et al. | 42/94 |
| 4,819,359 | 4/1989 | Bassett | 89/37.04 |
| 4,824,086 | 4/1989 | Rickling et al. | 269/156 |
| 4,924,616 | 5/1990 | Bell | 42/94 |
| 4,972,619 | 11/1990 | Eckert | 42/94 |
| 5,081,783 | 1/1992 | Jarvis | 42/94 |

OTHER PUBLICATIONS

Shooting Times, May 1987, vol. 28/No. 5, p. 36.

*Primary Examiner*—Stephen M. Johnson
*Attorney, Agent, or Firm*—Norman B. Rainer

[57] ABSTRACT

A portable shooters bench rest includes an elongated flat table panel of rectangular contour having a pivoted support leg at each corner. A forward support member is elevationally positionable above the table panel. A rear support member is positionable elevationally above the table panel and axially along the length of the table panel. A recoil-absorbing resilient tether can be employed whereby one extremity of the tether is attached to the table panel, and the opposite extremity of the tether is attached to a rifle resting upon the bench rest.

6 Claims, 3 Drawing Sheets

PORTABLE SHOOTER'S BENCH REST

BACKGROUND OF THE INVENTION

1. Field of the Invention

This invention relates to apparatus for supporting firearms during shooting, and more particularly concerns a portable shooter's bench rest useful for the accurate firing of rifles or handguns.

2. Description of the Prior Art

Shooting benches are generally cumbersome, large, and usually attached to the ground or a concrete foundation. Such features are considered desirable since they provide a steady, motionless rest for the shooter. However, these rests are of little, or no utility in uses other than at a target or practice range. While other rests have been designed for use in zeroing or sighting firearms, or for use in hunting or home practice situations, they do not provide the degree of support needed for accurate shooting, and are cumbersome to transport.

Several portable shooter's bench rests have been disclosed. For example, U.S. Pat. No. 4,501,082 to Phillips et al. discloses a rifle shooting bench having a horizontal upper member supported by collapsible, braced legs. Only one support point is provided, namely a support for the barrel portion of the firearm. The stock portion of the firearm is supported by the shooter. U.S. Pat. No. 4,702,029 discloses a rifle carrying case that also serves as a shooter's bench. A gun rest is provided for supporting the forward portion of the rifle.

U.S. Pat. No. 4,824,086 to Rickling discloses a portable bench rest shooting stand which employs clamping means for the rear portion of a rifle, and a rest for receiving the front portion of the rifle. The apparatus is of complex construction and does not appear suitable fop use with handguns.

U.S. Pat. No. 4,924,616 to Bell concerns a portable firearm rest having a fore rest whose height is treadably adjustable, and an aft rest that requires a threadably adjustable attachment to accommodate handguns.

It is accordingly an object of the present invention to provide a portable recoil-absorbing shooter's bench rest.

It is another object of this invention to provide a bench rest of the aforesaid nature having features of adjustability to accommodate rifles and handguns.

It is a further object of the present invention to provide a bench rest of the aforesaid nature having fore and aft rests permitting variable horizontal spacing therebetween.

It is a still further object of this invention to provide a bench rest of the aforesaid nature wherein fore and aft rests are capable of quick and easy vertical adjustment.

It is yet another object of the present invention to provide a bench rest of the aforesaid nature of simple, durable construction amenable to low cost manufacture.

These objects and other objects and advantages of the invention will be apparent from the following description.

SUMMARY OF THE INVENTION

The above and other beneficial objects and advantages are accomplished in accordance with the present invention by a portable recoil-absorbing shooter's bench rest comprising:

a) an elongated flat table panel of substantially rectangular contour bounded by upper and lower surfaces, elongated parallel side edges, and parallel front and rear end edges, thereby defining four corners of said panel, b) four straight support legs pivotally attached to said panel at said corners and adapted to be deployed downwardly in orthogonal relation to said table panel, the legs associated with the front edge being paired by way of at least one interactive stabilizing brace, the legs associated with the rear edge being paired by at least one interactive supporting brace, c) diagonal support struts adjustably interactive between each supporting brace and the lower surface of said table panel, d) a forward support member disposed above said table panel adjacent said front edge and elongated between lateral extremities aligned in parallel relationship to said side edges, e) a positioning lever pivotally attached to each lateral extremity of said forward support member, said lever further pivotably attached to the corresponding side edge of said table panel, and extending to a lower extremity located below said table panel, f) a coil spring joined to the lower extremity of each positioning lever and further joined to the corresponding leg in a manner permitting elevational adjustment thereupon, g) a rear support member elongated transversely to the longitudinal axis of said table panel and supported from beneath by a threaded rod coextensive with said panel and having extremities that extend beyond the side edges of said table panel, and h) paired holding panels that slidably embrace the side edges of said table panel, each holding panel having a vertically oriented slot that secures an extremity of said rod, whereby i) said rear support member is adjustably positionable axially along the table panel, and j) both support members are positionable elevationally with respect to said table panel.

In a preferred embodiment, a recoil-absorbing tether comprised in part of a coil spring has a first extremity anchored to said table panel between said forward and rear support panels, and a rearwardly disposed second extremity adapted to engage a firearm. In another embodiment, a retainer chain is interactive between said table panel and said positioning levers in a manner to prevent said forward support panel from pivoting rearwardly onto said table panel.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
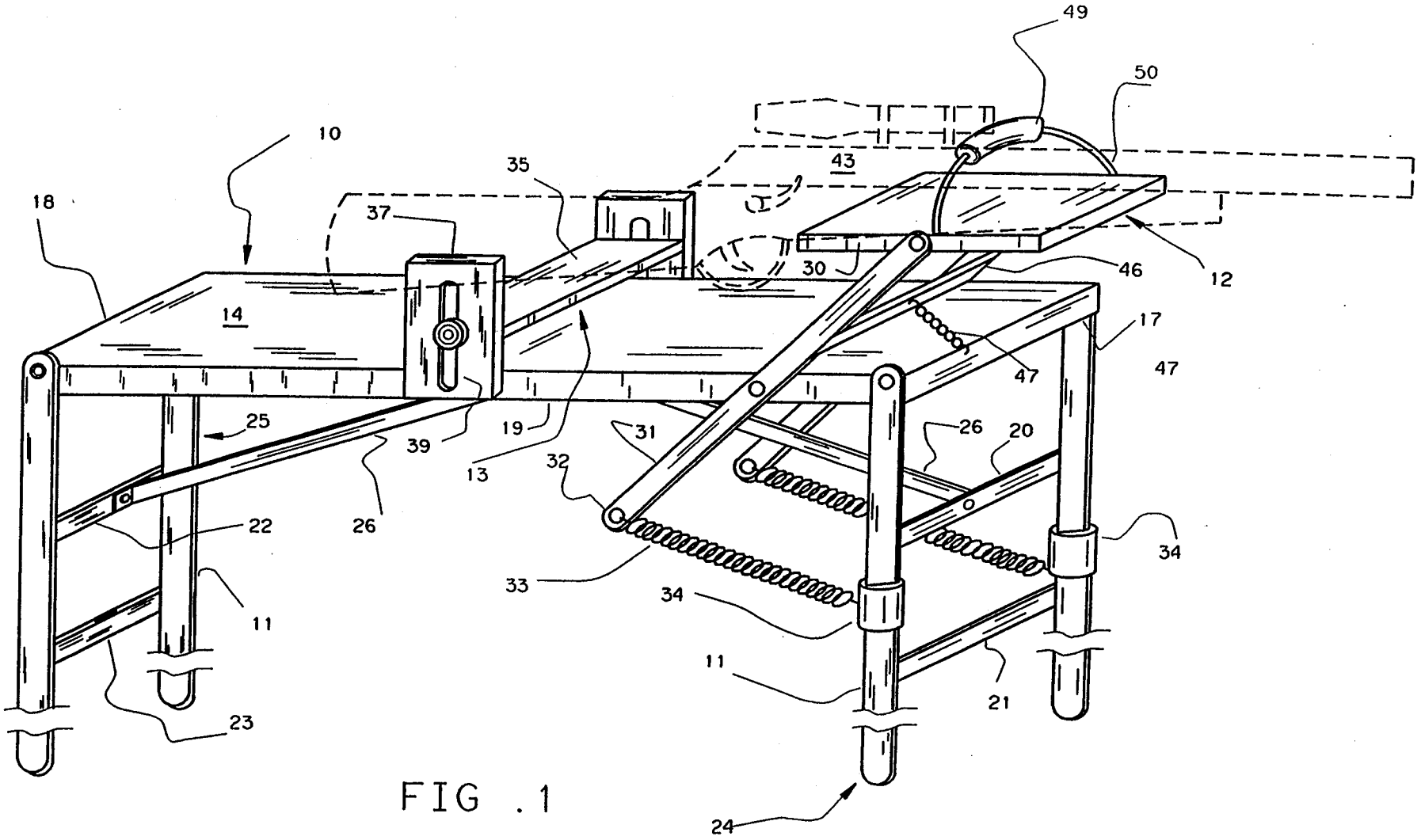
FIG. 1 is a front and side perspective view of an embodiment of the shooter's bench rest of this invention shown in functional association with a rifle.
Figure 2:
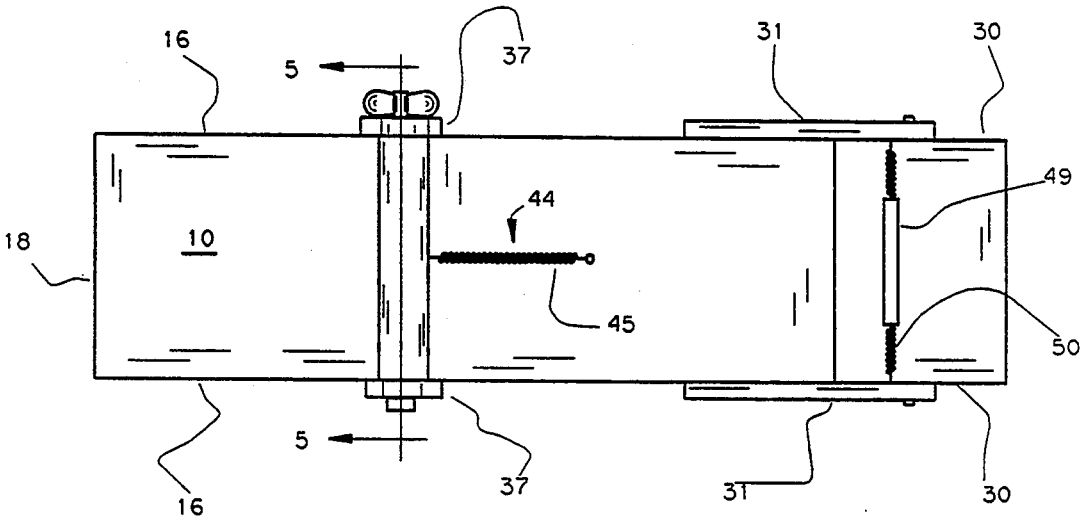
FIG. 2 is a top view of the embodiment of FIG. 1.

Referring to FIGS. 1–5, an embodiment of a portable shooter's bench of the present invention is shown consisting of elongated flat table panel 10 supported by legs 11, and forward and rear support members 12 and 13, respectively disposed above said table panel.

Table panel 10 is of elongated rectangular contour, bounded by flat upper and lower surfaces 14 and 15, respectively, elongated parallel side edges 16, and parallel front and rear end edges 17 and 18, respectively. Said table panel may be fabricated of metal, plastic or wood, and is designed to be of rigid, light-weight construction. Shoulder strips 19 descend from side edges 16. Said table panel may typically measure about nine inches in width, namely the distance of separation of side edges 16, and about 37 inches in length, namely the distance of separation of said end edges taken along the center axis of elongation of said panel.

Legs 11 are pivotably attached at their upper extremities to shoulder strips 19 adjacent said end edges, and are adapted to be deployed downwardly in orthogonal relationship to said table panel. The legs associated with the front edge are paired by way of upper and lower stabilizing braces 20 and 21, respectively. The legs associated with the rear edge are similarly paired by way of upper and lower stabilizing braces 22 and 23, respectively. Accordingly, the front legs may be referred to as a front pair of legs 24, and the rear legs may be referred to as a rear pair of legs 25. The legs are preferably fabricated of tubular aluminum, and typically have a length of about 32 inches.

Diagonal support struts 26 extend from each upper stabilizing brace to the lower surface 15 of the table panel at a site centered therein. At said site, securing means 27 permit removable attachment of the struts to said table panel. In the illustrated embodiment, securing means 27 is comprised of threaded post 28 which engages holes in said struts, and wing nut 29 interactive with post 28. Other equivalent securing means may, however, be employed.

Forward support member 12 is disposed above upper surface 14 of table panel 10 and adjacent front edge 17. Said forward support member is exemplified as being of elongated panel configuration and bounded in part by flat lateral extremities 30 aligned in parallel relationship to side edges 16 of said table panel. Jump-reducing means in the form of transverse holding bar 49 is disposed above support member 12, said bar being attached by stiff coil springs 50 to lateral extremities 30. When said jump-reducing means is not required, support member 12 can be pivotably inverted.

A positioning lever 31 is pivotably attached to each lateral extremity 80 and further pivotably attached to the corresponding shoulder strip 19. The lowermost extremity 32 of each lever is disposed at a location below said table panel. A coil spring 33 is attached to the lowermost extremity 32 of each lever 31. The opposite extremity of each coil spring 33 is attached to a collar 34 that is slideably positionable upon the corresponding front leg 11. By virtue of such manner of construction, any object placed upon said forward support member will descend to a position of equilibrium determined by the action of springs 33. Said positions of equilibrium can be altered by changing the elevational position of collar 34 on leg 11. It should be noted that leg 11, spring 33 and level 31 are disposed in a triangular relationship. When collar 34 is lowered, it causes the spring portion of said triangle to become larger, and this in turn exerts greater upward force upon forward support member 12.

Figure 3:
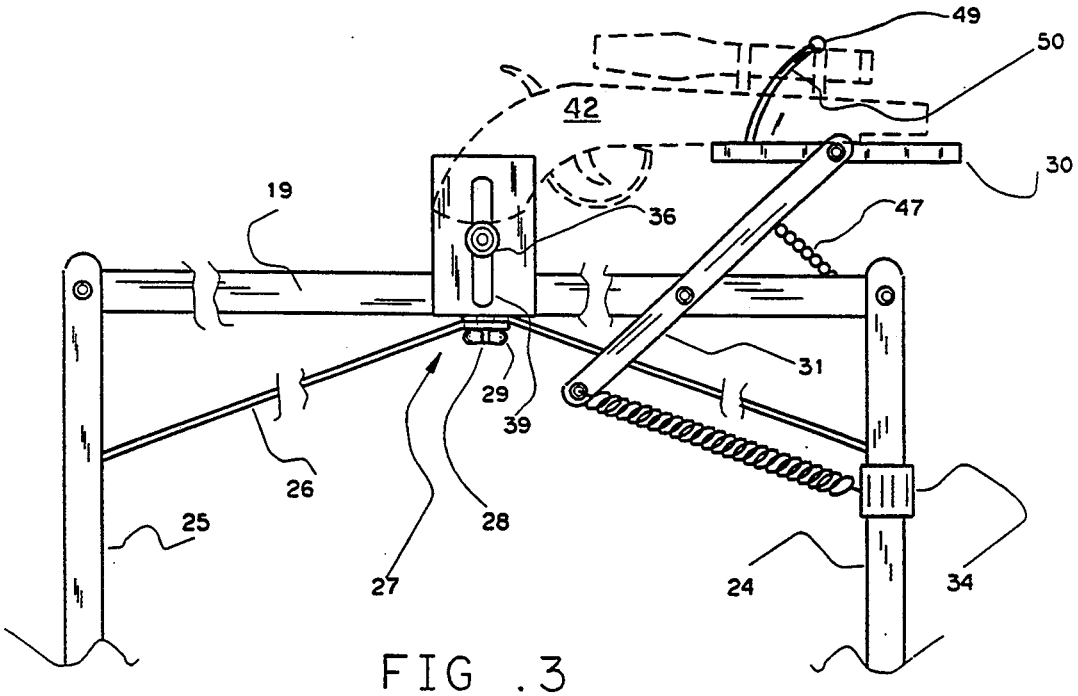
FIG. 3 is a fragmentary side view shown in functional association with a handgun.
Figure 4:
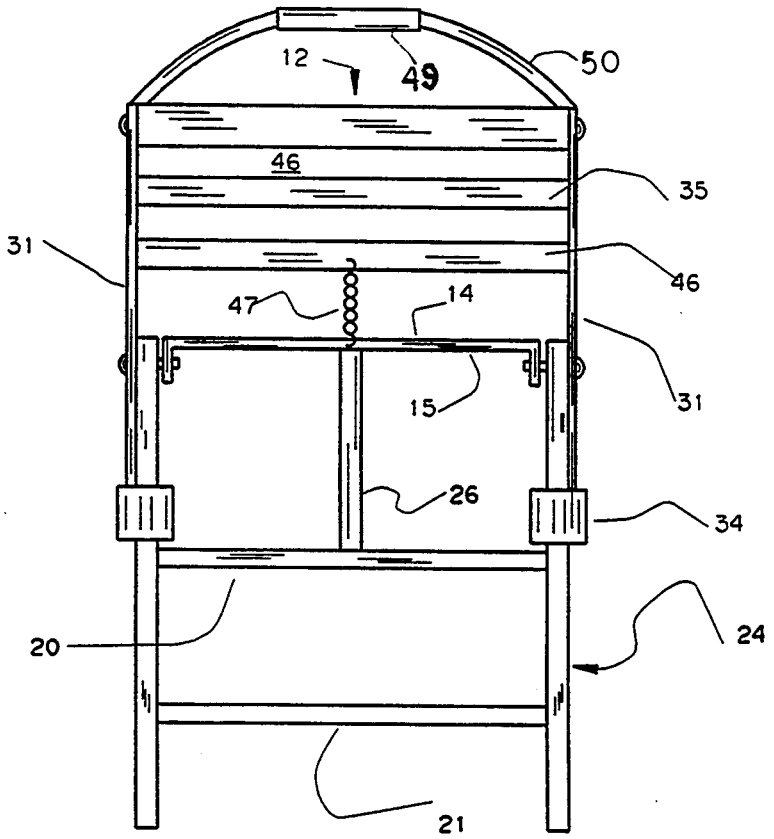
FIG. 4 is a front view.
Figure 5:
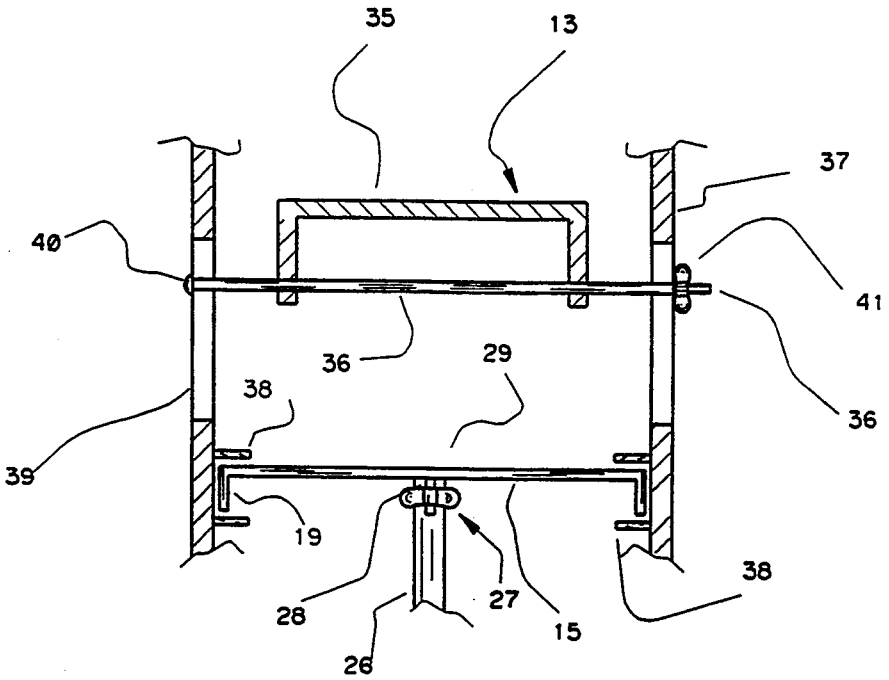
FIG. 5 is a sectional view taken upon the line 5—5 of FIG. 2.

Rear support member 13 is comprised of elongated platform 35 mounted upon threaded rod 36 and disposed transversely to the longitudinal axis of said table panel. Paired holding panels 37 slideably embrace shoulder strips 19 by way of track-like protuberances 38. Each holding panel 37 is further provided with a centered, vertically elongated slot 39. The extremities of rod 36 pass through slots 39 of holding panels 37 disposed in facing relationship. One extremity of rod 36 rests in fixed abutment with the first of said holding panels by way of a flat head formation 40. The opposite extremity of rod 36 is threaded, and adjustably engages wing nut 41 which abuts against the second of said holding panels. By virtue of such manner of construction, platform 35 can be adjustably positioned axially and elevationally with respect to the table platform. It may also be pivoted above rod 36, and can be secured in an appropriate position by tightening wing nut 41. When moved close to the forward support member, as shown in FIG. 3, rear support member 13 serves as a rest for the butt end of a pistol 42. When located further rearwardly from forward support member 12, rear support member 13 serves as a rest for the stock portion of rifle 43.

A recoil-mitigating tether 44 comprising restraining coil spring 45 is disposed upon upper surface 14 of said table panel. The forward or proximal extremity of said tether is anchored to said table panel. The free, distal extremity of tether 44 is adapted to attach to the conventional rear, sling-holding swivel eye of the stock of rifle 43.

A cross bar 46 is disposed between levers 31 at a site between said table panel and forward support member 12. A chain 47 extends interactively between cross bar 46 and table panel 10. The effective length of the chain is adjustable by way of a standard S-hook. Its purpose is to prevent forward support member 12 from swinging backwardly. Both said forward and rear support members may be provided with an upper layer of cushioning material.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described, my invention, what is claimed is:

1. A portable shooter's bench comprising:

a) an elongated flat table of substantially rectangular contour bounded by upper and lower surfaces, elongated parallel side edges, and parallel front and rear edges, thereby defining four corners of said panel, b) four straight support legs pivotally attached to said panel adjacent said corners and adapted to be deployed downwardly in substantially orthogonal relationship to the upper surface of said table panel, the legs associated with the front edge being paired by way of at least one interactive stabilizing brace, the legs associated with the rear edge also being paired by at least one interactive stabilizing brace, c) a diagonal support strut adjustably interactive between a stabilizing brace and the lower surface of said table panel, d) a forward support member disposed above said table panel adjacent said front edge and having lateral extremities aligned in parallel relationship to said side edges, e) a positioning lever pivotally attached to each said lateral extremity of said forward support member, said lever further pivotably attached to the corresponding side edge of said table panel, and extending to a lower extremity located below said table panel, f) a coil spring joined to the lower extremity of each said positioning lever and further joined to the corresponding leg in a manner permitting elevational adjustment thereupon, g) a rear support member elongated transversely to the side edges of said table panel and supported from beneath by a threaded rod having extremities that extend beyond the side edges of said table panel, and h) paired holding panels that slidably embrace the side edges of said table panel, each said holding panel having a vertically oriented slot that secures an extremity of said rod, whereby i) said rear support member is adjustably positionable axially along the table panel, and j) both said support members are positionable elevationally with respect to said table panel.

2. The bench rest of claim 1 further including a recoil-absorbing tether comprised in part of a coil spring having a first extremity anchored to said table panel between said forward and rear support panels, and a rearwardly disposed second extremity adapted to engage a firearm.

3. The bench rest of claim 1 further including a retainer chain interactive between said table panel and said positioning levers in a manner to prevent said forward support panel from pivoting rearwardly onto said table panel.

4. The bench rest of claim 1 further including spring-activated jump-reducing means disposed above said forward support member and attached to the lateral extremities of said forward support member.

5. The bench rest of claim 1 wherein said coil spring, and corresponding positioning lever and leg are disposed in a triangular relationship.

6. The bench rest of claim 1 wherein a cross bar is disposed between said levers, and a chain of adjustable effective length extends between said cross bar and said table panel.

* * * * *